United States Patent [19]

Seidentop et al.

[11] Patent Number: 4,566,693

[45] Date of Patent: Jan. 28, 1986

[54] GRAVITY TRACTION APPARATUS

[75] Inventors: Alfred T. Seidentop, Santa Maria; John E. Johnson, Villa Park, both of Calif.

[73] Assignee: Stretch Forming Corporation, Fountain Valley, Calif.

[21] Appl. No.: 385,682

[22] Filed: Jun. 7, 1982

[51] Int. Cl.[4] ..... A63B 23/04

[52] U.S. Cl. ..... 272/144; 128/75; 128/71

[58] Field of Search ..... 128/24 R, 69, 70, 71, 128/68, 75, 133, 65; 272/109, 144

[56] References Cited

U.S. PATENT DOCUMENTS

| | | | |
|---|---|---|---|
| 1,693,810 | 12/1928 | Daniels et al. | 128/70 |
| 3,593,708 | 7/1971 | Steele | 128/65 |
| 3,598,405 | 8/1971 | Burns | 272/145 |
| 3,752,153 | 8/1973 | Copeland | 128/24 R |
| 3,857,561 | 12/1974 | Cecchettini et al. | 272/144 |
| 3,874,375 | 4/1975 | Penner | 128/75 |
| 4,077,403 | 3/1978 | Steele | 128/75 |
| 4,103,681 | 8/1978 | Shanley | 128/71 |
| 4,256,300 | 3/1981 | Boucher | 272/85 |
| 4,292,962 | 10/1981 | Krause | 128/68 |

FOREIGN PATENT DOCUMENTS

| | | | |
|---|---|---|---|
| 724531 | 12/1965 | Canada | 272/109 |
| 1365542 | 9/1971 | United Kingdom | 128/75 |

*Primary Examiner*—Richard J. Apley
*Assistant Examiner*—David J. Brown

[57] ABSTRACT

A gravity traction apparatus including an adjustable and collapsible A-frame with a transversely extending beam member at the top. Pivotally mounted on the beam member is a generally flat thigh-pad structure which has a T-shaped knee-stop member extending upwardly and rearwardly from adjacent the rear portion thereof.

Stop means are provided to limit the pivotal movement of the thigh-pad structure between an inoperative position in which it is in a generally vertical position and a user is in a standing position at the rear of the frame, and an operative position in which it is generally horizontal and the user is supported thereon and hanging over the beam member with his head in a downward position.

3 Claims, 13 Drawing Figures

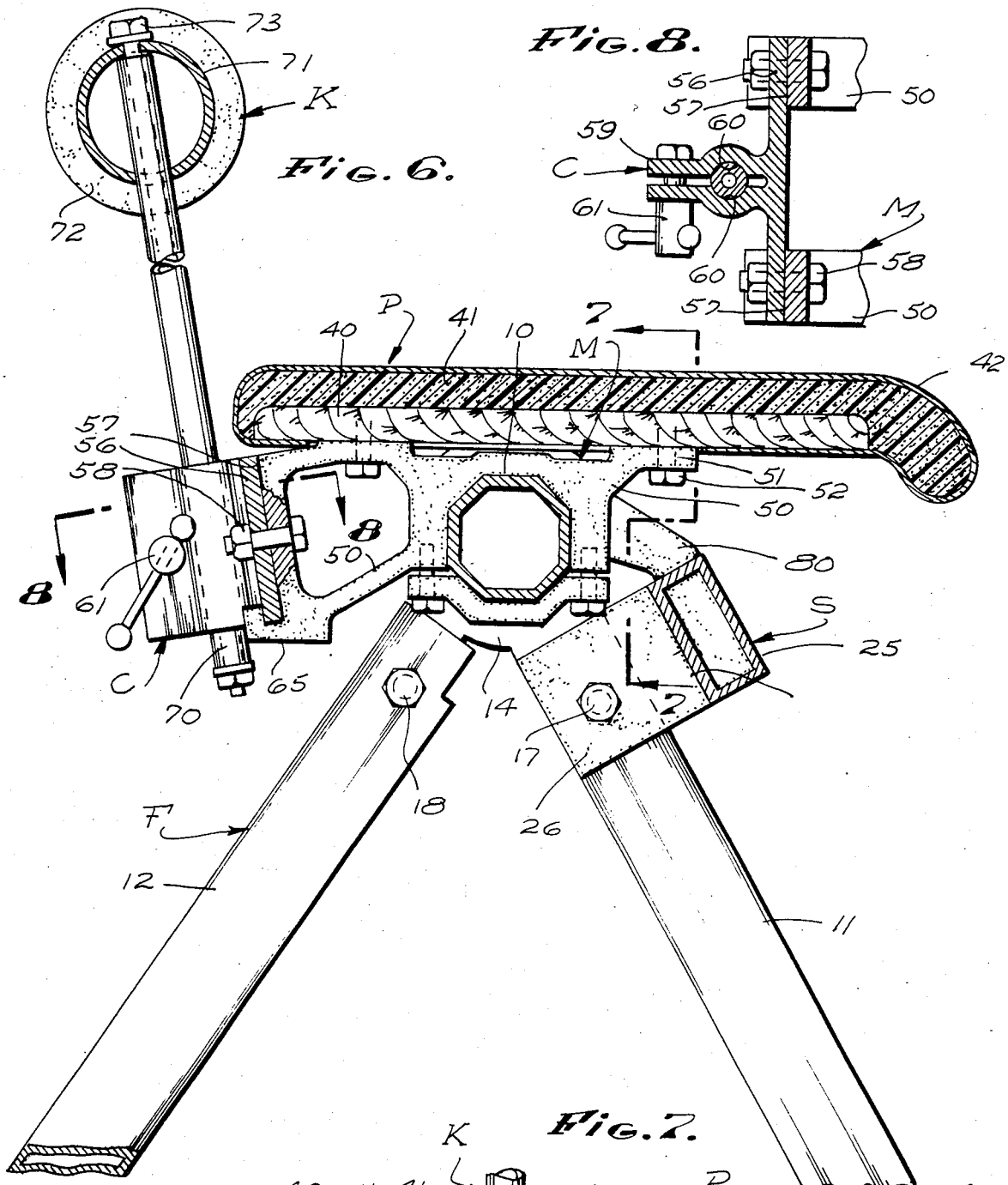
Fig. 6.
Fig. 8.
73
71
K
72
56
57
50
59
60
C
61
M
58
P
41
10
7
40
42
51
52
80
S
25
8
65
70
14
17
18
26
F
12
11
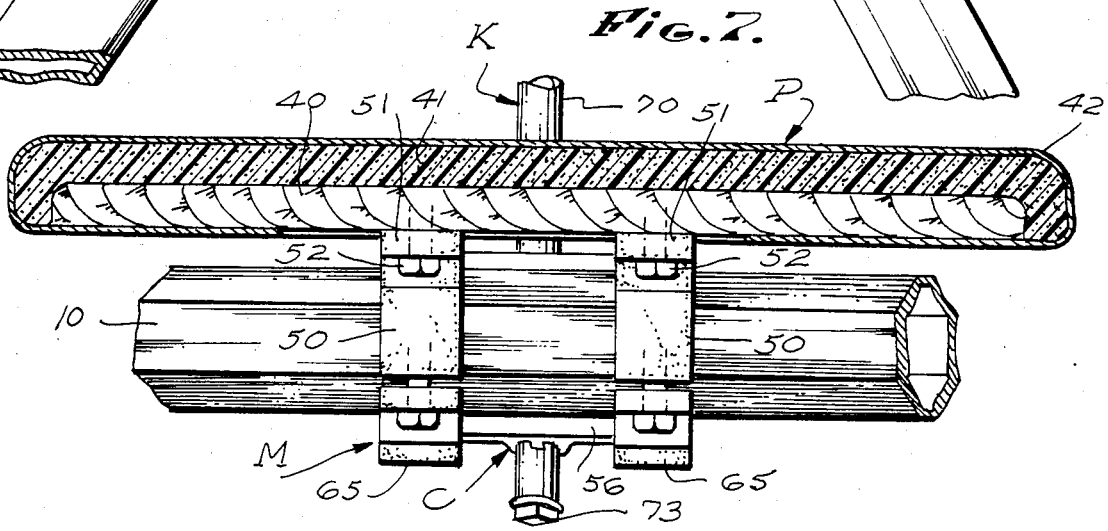
Fig. 7.
K
40
51
41
70
P
42
52
10
50
M
65
C
56
73

GRAVITY TRACTION APPARATUS

BACKGROUND AND BRIEF SUMMARY OF THE INVENTION

This invention pertains generally to physical conditioning apparatus for humans, and more particularly to a novel gravity traction apparatus for alleviating back discomfort.

In the treatment of various back ailments, it has long been recognized that inverting a human body and subjecting the spine and back thereof to traction through the force of gravity, provides significant benefits.

Accordingly, the prior art has sought to provide apparatus to enable individuals to conveniently and safely subject their spines and backs to gravity traction. Throughout the years the gravity traction apparatus provided by the prior art has varied considerably, but has characteristically involved suspended trapeze bars from which the user hangs by his feet, utilizing special shoe-type devices containing hooks which engage the bar, or by hooking his legs over the bar, whereby the person's body depends in the downward direction to submit the back and spine to a stretching action.

Other prior art devices utilize a "see-saw" arrangement, with the user being strapped to a pivotally mounted board, whereby he can be maneuvered to a head-downward position.

Typical of the aforementioned devices are the horizontal bar arrangements disclosed in U.S. Pat. Nos. 3,593,708, 3,874,375 and 4,077,403, and the pivotally mounted board arrangements disclosed in U.S. Pat. Nos. 3,752,153 and 4,103,681. The apparatus provided by the prior art and referred to above have numerous disadvantages or deficiencies.

Firstly, in order for persons to utilize the trapeze-bar apparatus, the bar must be suspended at a substantial heighth and the user must climb or otherwise engage in physical maneuvering which requires considerable strength, dexterity and coordination. Needless to say, persons of an advanced age and persons of all ages with painful back problems do not possess the strength or mobility to utilize such apparatus.

Secondly, with the bar being supported a substantial distance above the floor, there is an ever present danger of the user falling from the bar and striking his head on the floor or injuring his neck, thereby increasing his disability.

With regard to the pivotally mounted board-type apparatus, a major problem is that it usually requires another person to strap the user in position and/or to maneuver the board to a vertical or near vertical position with the user's head below the other parts of his body.

With the foregoing limitations and deficiencies of known devices in mind, it is an object of the present invention to provide a novel gravity traction apparatus which does not require the user to climb to an elevated position or otherwise engage in strenuous gymnastics in order to utilize it. More particularly, it is a primary object to provide such an apparatus which can be used by persons with little or no gymnastic skills, particularly persons of advanced age and persons with limited mobility due to existing back discomfort.

It is a further object to provide such an apparatus which is relatively safe to use by even the most inexperienced and non-athletic persons.

Yet another object is to provide such an apparatus which is portable, which is self-supporting, which can be used in a limited floor-space area, and which can be collapsed and stored out of sight when not in use.

An additional object is to provide such an apparatus which can be quickly and easily adjusted to accommodate persons of different heights and sizes.

And, furthermore, it is an object to provide such an apparatus which is rugged and durable, and yet which is relatively inexpensive.

We have discovered that the above objects and advantages are achieved by a portable floor-mounted frame on which a padded thigh-engaging structure is pivotally mounted, said structure supporting an adjustable, transversely extending knee-stop member in rearward spaced relationship, whereby the user can position himself in the apparatus while standing on the floor, with his thighs engaging the padded structure and with the knee-stop member in contact with the back of his legs, whereby he can achieve a gravity traction position by merely leaning forward while grasping handle members mounted on the frame, and pivoting his body from the vertical standing position to a position in which he is, in effect, hanging head downward over the frame.

The legs of the frame are adjustable, and the position of the knee-stop member is adjustable relative to the thigh-engaging padded structure to accommodate users of different heights and sizes.

The frame is also collapsible to provide for storage of the apparatus in a closet or other limited space, when not in use.

The foregoing and other objects of the invention will be fully understood from the following detailed description of one typical embodiment of the invention, throughout which description reference is made to the accompanying drawings:

DESCRIPTION OF THE DRAWINGS

FIG. 6 is an enlarged, vertical sectional view taken substantially as indicated by line 6—6 on FIG. 1;

FIG. 7 is a fragmentary, vertical sectional view taken substantially as indicated by line 7—7 on FIG. 6;

FIG. 8 is a fragmentary, horizontal sectional view taken as indicated by line 8—8 on FIG. 6;

DETAILED DESCRIPTION OF THE INVENTION

Figure 1:
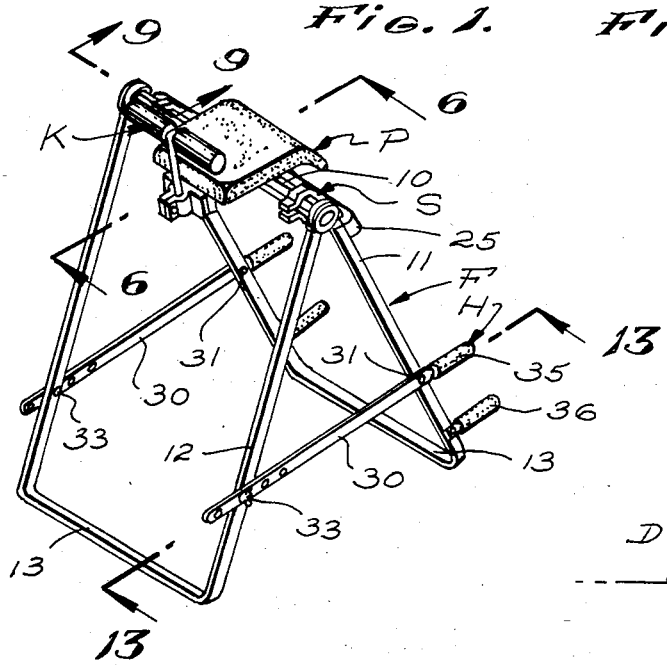
FIG. 1 is an isometric view of the preferred form of gravity traction apparatus constructed in accordance with the teachings of the present invention, shown in the operative position.
Figure 2:
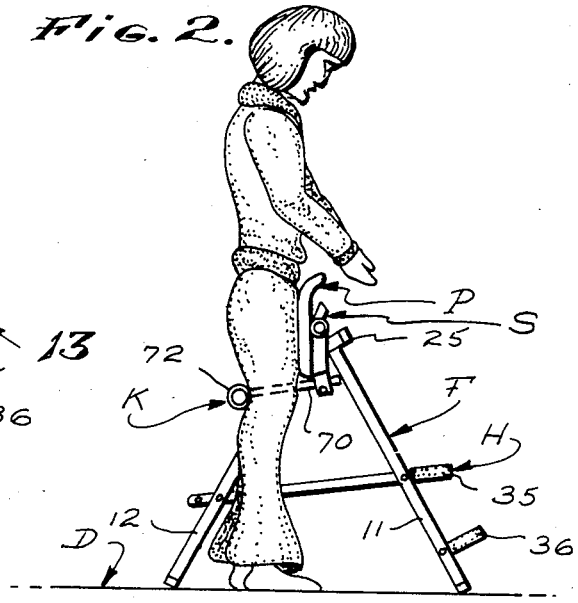
FIGS. 2, 3, 4 and 5 are side elevational, diagrammatic views of the apparatus with a person engaged therewith and showing the apparatus and the person in different positions as will be described more fully hereinafter.
Figure 3:
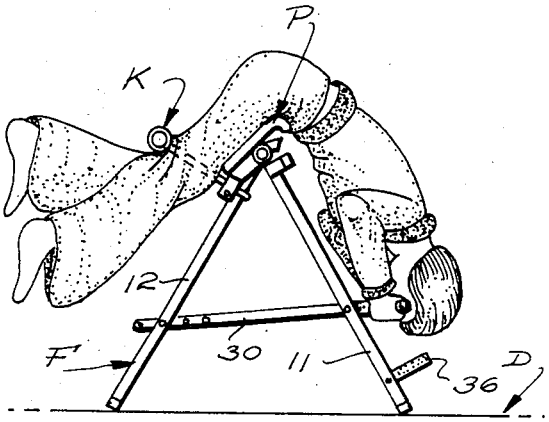
Figure 4:
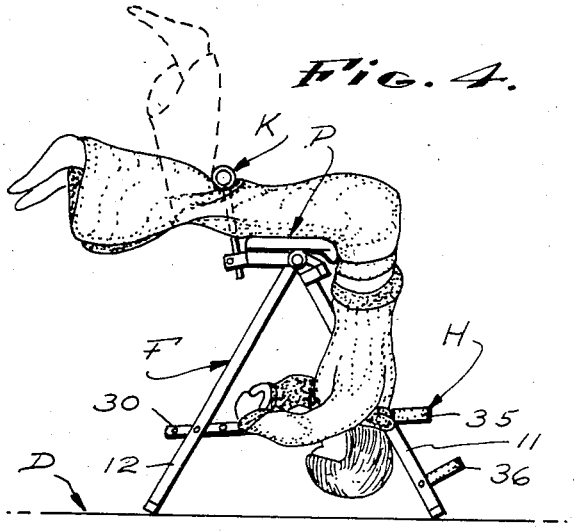
Figure 5:
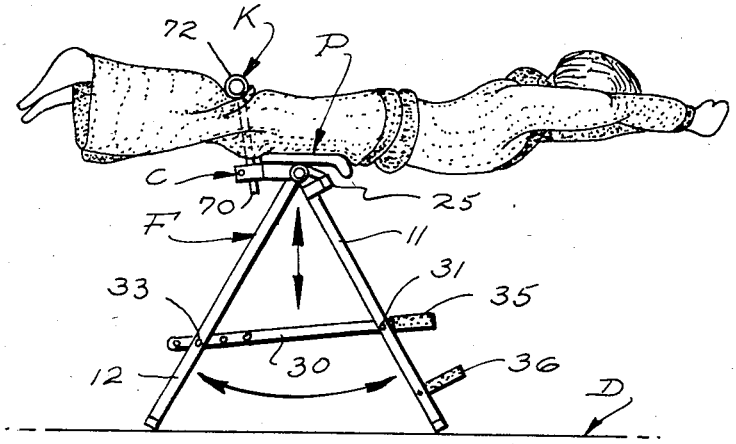

The gravity traction apparatus A embodying the teachings of the present invention shown in the accompanying drawings, includes a floor or deck engaging frame structure F and a thigh engaging pad structure P with a related knee-stop structure K pivotally supported by the frame structure F in vertical spaced relationship above a related deck D and pivotally movable between a normal in-use or operative position as shown in FIGS. 3, 4 and 5 of the drawings, and a non-use or inoperative position as shown in FIG. 2 of the drawings.

Figure 13:
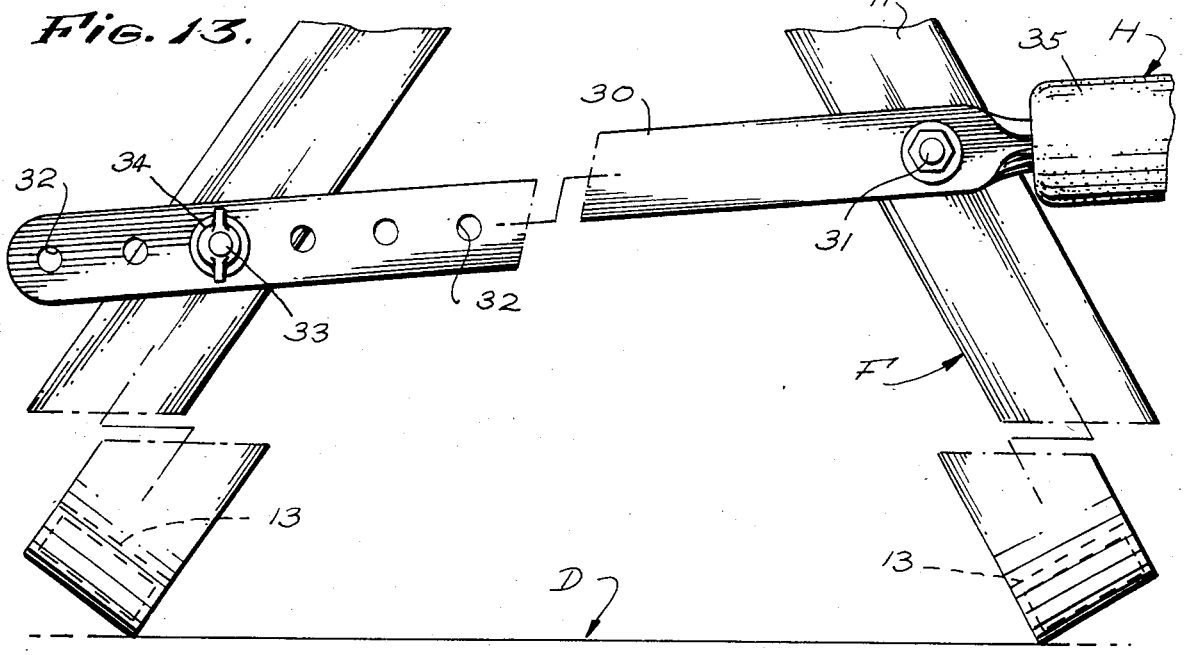
FIG. 13 is an enlarged, fragmentary, elevational view taken substantially as indicated by line 13—13 on FIG. 1.

The frame structure F is a foldable or collapsible A-frame type structure including an elongate horizontal transversely extending upper beam 10 (FIG. 6), laterally spaced forwardly and downwardly inclined front legs 11 and laterally spaced and downwardly inclined rear legs 12 coupled with the opposite ends of the beam 10. The lower ends of the pairs of front and rear legs 11 and 12 are integrally joined by transversely extending, horizontal, deck-engaging bases 13 (FIG. 13) and are in fact the leg portions of U-shaped frame parts.

Figure 9:
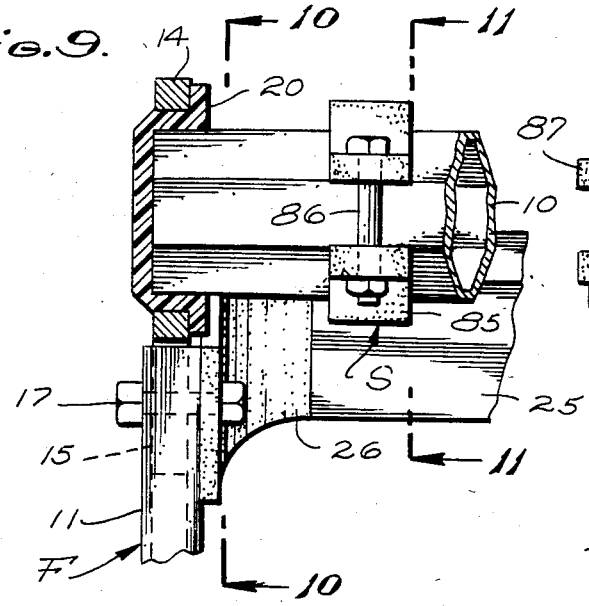
FIG. 9 is an enlarged fragmentary, vertical, sectional view taken substantially as indicated by line 9—9 on FIG. 1.
Figure 10:
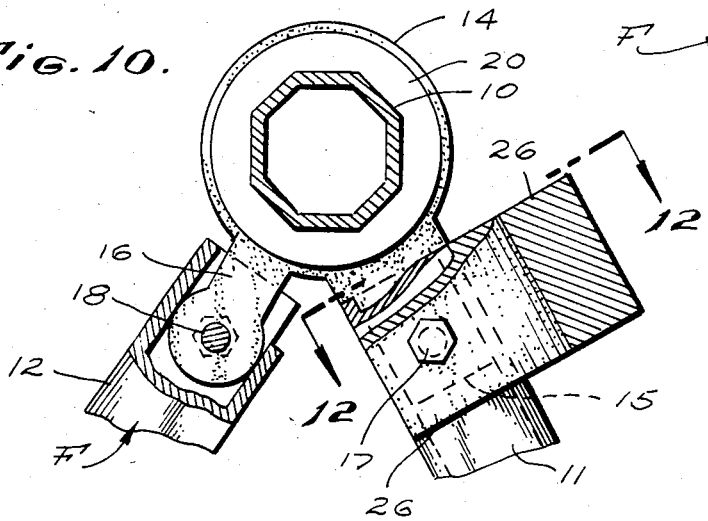
FIG. 10 is a vertical, sectional view taken as indicated by line 10—10 on FIG. 9.

The upper converging ends of the related front and rear legs are coupled and secured together by apertured end plates 14 (FIG. 9) with which the ends of the beam 11 are engaged and which have elongate tabs 15 and 16 which are slidably entered into the upper open ends of the legs 11 and 12. The tabs 15 are rectangular in cross-section, slidably enter their related front legs 11 and are secured therein by screw-fastening means 17. The tabs 16 have circular ends slidably and rotatably engaged in their related ends of the rear legs and which are retained in those legs by screw-fastening means 18. The circular ends of the tabs 16 are integrally joined with the plates 14 by narrow necks (FIG. 10). With the above construction, it will be apparent that the front and rear legs 11 and 12 are effectively pivotally coupled at their upper ends whereby the frame can be pivotally collapsed and opened, as circumstances require, and that the angle between the front and rear legs can be varied to adjust the vertical spacing of the beam 10 above the deck D.

The beam 10 is shown as an elongate polygonal extruded metal tube and is provided with cylindrical bearing caps 20 at its opposite ends. The bearing caps 20 are press-fitted about the ends of the beam B and are slidably and rotatably engaged in and carried by the apertured plates 14. In the construction illustrated, the bearing caps 20 are provided with inner radially outwardly projecting retaining flanges 21 engageable with the inner surfaces of the plates to prevent axial shifting of the beam in and between said plates.

The frame structure F further includes an elongate transversely extending tie-bar 25 (FIG. 6) extending between and joined with the upper end portions of the front legs 11. The bar 25 holds and prevents the upper ends of the legs from spreading laterally outwardly and out of working relationship with the ends of the beam 10. The bar 25 also serves as a part of a stop structure S which will hereinafter be described.

Figure 12:
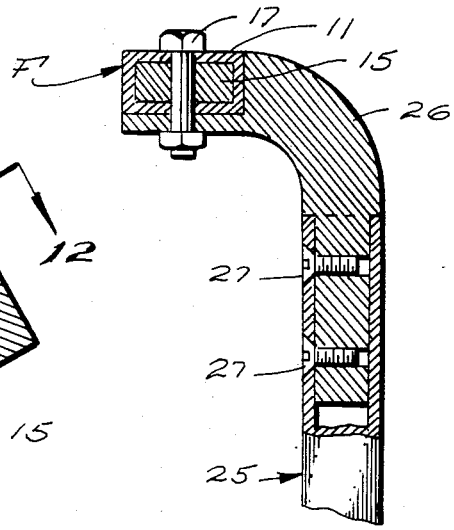
FIG. 12 is a horizontal, sectional view taken substantially as indicated by line 12—12 on FIG. 10.

As illustrated, the bar 25 is established of a length of rectangular in cross-section metal tube stock and its ends are connected with related ends of the front legs 11 by angle fittings 26 (FIG. 6) engaged in the ends of the tube and about the legs 11. The fittings 26 are secured with their related structure by the screw-fastening means 17 and by screw-fasteners 26 (FIG. 12).

It is to be noted that the bar 25 occurs forward of the upper end portions of the legs 11.

Additionally, the frame structure F includes spreaders 30 (FIG. 13) at each of its ends to releasably hold the pairs of front and rear legs in set angular relationship with each other. The spreaders 30 are elongate, strap metal bars with front and rear ends. The front ends of the bars 30 are pivotally fastened to the central portions of their related front legs 11 by bolt fastener means 31. The rear portions of the spreaders 30 are formed with a plurality of longitudinally spaced fastener shank receiving openings 32 to adjustably receive the threaded shanks 33 of laterally projecting fasteners on the central portions of the rear legs 12. The spreaders can be suitably retained on the fasteners by wing nuts 34 engaged on the fasteners.

With the spreaders 30 described above, it will be apparent that the frame F is releasably held in any desired adjusted position. The height of the beam 10 above the floor or deck D can be varied by disengaging the spreaders 30 from the fastener shanks 33, manually adjusting the angle between the front and rear legs and then re-engaging the shanks in appropriate openings 32 in the spreaders 30.

It will also be noted that the spreaders 30 can be completely disengaged from the rear legs 12 and moved into a generally parallel relationship with the front legs 11, whereupon the frame can be folded generally flat for convenient transport and/or storage.

In addition to the above, the frame F is preferably provided with a plurality of handle means H at the front legs 11 to facilitate a person lowering and raising his body in and relative to the frame. In the construction illustrated, the handle means H includes hand grips 35 (FIGS. 1–5) established by forwardly extending extensions of the spreaders 30 and which project forwardly from the legs 11 and generally at a right angle thereto. If desired, additional hand grips 36 are provided on the front legs 11, preferably below the hand grips 35, and which also extend generally at a right angle to the front legs to better support the user in moving between the operative and inoperative positions. For purposes of comfort, the hand grips are covered with rubber or plastic sleeves.

The thigh pad structure P (FIGS. 6 and 7) comprises a flat, rectangular plate 40 of sufficient size and shape to afford support for the thighs of a person throughout the major frontal area thereof. The plate 40 can be made of plywood or the like, and its top surface, sides and ends are preferably covered with upholstery material such as a pad 41 of soft, resilient foam plastic and an outer cover 42 of plasticized fabric. As shown in FIG. 6, the front portion of the 41 extends forwardly and downwardly of the front end of the plate 40, to conform to the body of the user in the operative position.

The pad structure P is securely mounted on the beam 10 intermediate the ends thereof, by a mounting fixture M (FIG. 6). The mounting fixture M can vary widely in construction and is shown as a fabricated structure comprising a pair or elongage laterally spaced parallel mounting blocks 50 (FIG. 7) with upper pad portions 51 engaging the bottom surface of and fastened to the plate 40 by fastener means 52. The blocks 50 have downwardly and laterally opening polygonal beam receiving seats 53. The beam 10 is seated in the seats 52 and is retained therein by keepers 54 underlying the beam and secured to the blocks by screw fasteners 55.

The fixture M further includes a transversely extending upwardly and rearwardly inclined anchor plate 56. The opposite ends of the plate are secured to rear and downwardly disposed faces 57 on the blocks 50 by screw fastening means 58.

The anchor plate 56, in addition to maintaining the blocks 50 in spaced relationship, carries a screw actuated post clamp means C (FIG. 6) for the knee-stop structure K. The clamp means C (FIG. 8) comprises a pair of laterally spaced rearwardly projecting vertical plates 59 with opposing vertical post receiving channels 60 and a manually operable clamp screw assembly 61 rearward of the channels 62, extending between the plates 59 and operable to draw the plates together and into tight clamped engagement with a post 70 of the means K engaged between the plates and in said channels.

The blocks 50 are formed to define flat, downwardly disposed stop surfaces 65 at their rear ends (FIGS. 6 and 7). The stop surfaces 65 on the blocks 50 move into stopped engagement with a downwardly and rearwardly disposed surface of the spreader bar 25 of the frame structure F when the rear portion of the thigh pad structure is pivoted downwardly and rearwardly about the axis of the beam 10 and within the frame F, as shown in FIG. 2 of the drawings.

The knee-stop structure K (FIG. 6) comprises an elongage, laterally extending stop member 71 which normally occurs in spaced relationship above and rearward of the rear edge of the thigh pad P. The member 71 is provided to engage behind (above) the knee of a user of the apparatus and is carried by the thigh pad structure P. The stop member 71 is shown as a large diameter metal tube, the opposite end portions of which are covered and protected by soft, resilient sock-like tubular pad structures 72. The member 71 is secured to the upper end of the post 70. The upper end portion of the post 70 is engaged through a central opening in the lower side of the tube member 70 and its upper end is moved into stopped engagement with the upper inner surface of the member. An elongate tie-bolt and nut assembly 73 extends through the post 70 and member 71 to clamp the post and member together and to establish what can be termed a T-frame like structure.

The lower end of the post 70 is releasably clamped in the channels 62 of the above described clamp means C on the fixture M.

It will be apparent that by releasing the clamp means, the post 70 can be raised or lowered to adjust the vertical space between the stop member 71 and the thigh pad P and to thereby adjust the structure to best accommodate and engage the legs of different persons using the apparatus.

Figure 11:
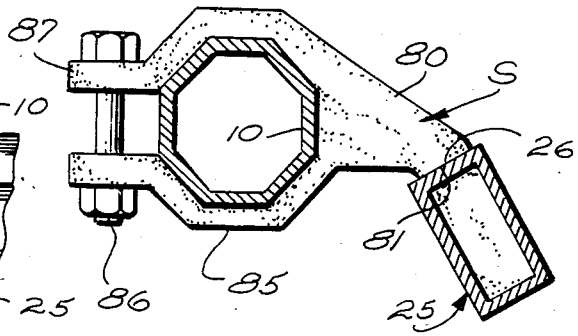
FIG. 11 is a vertical, sectional view taken as indicated by line 11—11 on FIG. 9.

The stop means S referred to above, is provided to stop forward and downward movement of the thigh pad structure P and to hold it in its horizontal operative position. In the form of the invention illustrated, the stop means S (FIG. 11) includes laterally spaced and forwardly projecting stop arms 80 with downwardly and forwardly disposed stop surfaces 81 normally engaging and stopped on the upper and rearwardly disposed upper surfaces 26 of the spreader bar 25 of the frame structure F. The stop arms 80 are positioned at the opposite end portions of the beam 10 and include enlarged polygonal, split, band type mounting means 85 (FIG. 11) at their rear ends and engaged about the beam 10. The means 85 is maintained in tight, clamped engagement about the beam by screw fastener means 86 engaged through and between rearwardly projecting tabs 87 of the means 85.

In use and as shown in FIGS. 2, 3, 4 and 5 of the drawings, the thigh pad structure P and its related knee-stop structure K are moved to their inoperative position (FIG. 2) and the person using the apparatus, standing at the rear thereof and facing forward, steps forward and straddles the post 70, with his legs forward of the knee-stop structure K and with his thighs in engagement with the thigh pad P.

Thereafter, the user bends forward and downward over the bar 10, reaching for and engaging one set of handles H with his hands (FIG. 3). As the above movements are performed, the user allows his feet to leave the ground and his legs to elevate and pivot up to horizontal position as shown in FIG. 3 of the drawings. As the user moves from the position shown in FIG. 2 of the drawings to the position shown in FIG. 3 of the drawings, the thigh pad structure P rotates about the axis of the beam 10 and allows the user's body to move freely. Upon further forward and downward movement of his body under control of his hands and arms, the pad P moves to its horizontal operative position, the upper legs and thighs of the user are supported atop the pad structure P in horizontal disposition with the knee-stop member K engaged above the backs of the user's knee to hold his legs and thighs down and over the pad.

Thereafter, the user releases the handles H and permits the upper portion of his body to swing freely downwardly at right angle to his legs, to the position shown in FIG. 4 of the drawings, in which position his spine and back are in traction due to the force of gravity acting on the upper portion of his body.

In practice, if the user senses that he is moving forward on the pad P or is set too far forward thereon, or if it is more comfortable, he can bend his legs upwardly at the knees, as shown in dotted lines in FIG. 4 of the drawings. Bending the knees, as shown in FIG. 4 of the drawings, works to maintain the user in proper engagement on the pad P and will work to draw the user rearwardly into proper engagement on the pad P should he be set or moved too far forward thereon.

To move from the operative position shown in FIG. 4 to the imoperative position shown in FIG. 2, the user need only use his hands and arms against one or both sets of handles H to reassume a position similar to that shown in FIG. 3 of the drawings, and by continuing to push against the handles H and moving his legs and feet downwardly, achieve the inoperative position shown in FIG. 2.

In practice, and as shown in FIG. 5 of the drawings, the user, after attaining the position in FIG. 4 of the drawings, can exercise and strengthen his back and abdominal muscles by arching his back and extending his body horizontally forward from the pad structure P. While this form of back exercise is commonly performed on various other kinds of exercise apparatus, the ease and comfort with which it can be performed when using the subject apparatus is of particular advantage.

Thus, it is apparent that there has been provided a novel gravity traction apparatus which fulfills all of the objects and advantages sought therefor, and which can be safely utilized by persons having limited strength and agility.

Having described only one typical preferred embodiment of the invention, we do not wish to be limited to the specific details herein set forth but wish to reserve to ourselves any modifications and/or variations that might appear to those skilled in the art and which fall within the scope of the following claims:

We claim:

1. A gravity traction apparatus for human users, comprising:

a vertically-extending frame with front and rear sides for mounting on a floor or like surface and including a horizontally disposed, transversely-extending beam member supported adjacent the upper end thereof;

a thigh-pad structure with a generally flat, thigh-engaging surface having front and rear portions, supported on said beam member for pivotal movement between an inoperative position in which said surface is generally vertically disposed and an operative position in which said surface is generally horizontally disposed; and a knee-stop member and supporting means therefor carried by the thigh-pad structure, said knee-stop member including a transversely-extending leg-engaging portion which is spaced downwardly and rearwardly relative to the rear portion of said thigh-engaging surface when the thigh-pad structure is in the inoperative position, said supporting means being at a fixed distance relative to the rear portion of said thigh-pad structure, the amount of the spacing of the knee-stop member from said supporting means causing the leg-engaging portion to engage the legs of a user in the areas in back of the knees when the user is standing on the surface on which the frame is mounted and between said knee-stop member and said thigh-engaging surface, in which the frame includes spaced-apart front legs and stop means for limiting the pivotal movement of the thigh-pad structure between the inoperative position and the operative position, which stop means includes a tie-bar connected to and extending between the front ends adjacent to the beam member.

2. A gravity traction apparatus for human users, comprising:

a vertically-extending frame with front and rear sides for mounting on a floor or like surface and including a horizontally disposed, transversely-extending beam member supported adjacent the upper end thereof;

a thigh-pad structure with a generally flat, thigh engaging surface having front and rear portions, supported on said beam member for pivotal movement between an inoperative position in which said surface is generally vertically disposed and an operative position in which said surface is generally horizontally disposed; and a knee-stop member and supporting means therefor carried by the thigh-pad structure, said knee-stop member including a transversely-extending leg-engaging portion which is spaced downwardly and rearwardly relative to the rear portion of said thigh-engaging surface when the thigh-pad structure is in the inoperative position, said supporting means being at a fixed distance relative to the rear portion of said thigh-pad structure, the amount of the spacing of the knee-stop member from said supporting means causing the leg-engaging portion to engage the legs of a user in the areas in back of the knees when the user is standing on the surface on which the frame is mouonted and between said knee-stop member and said thigh-engaging surface, in which said vertically-extending frame includes complementary sets of front and rear legs having upper ends;

bearing plates mounted at each end of the beam member and including two angularly-disposed tabs;

means rigidly connecting the upper ends of one of the sets of front and rear legs to one of said tabs;

means pivotally connecting the upper ends of the other set of front and rear legs to the other of said tabs; and at least one elongated spreader member extending between the sets of front and rear legs to vary the pivotal relationship therebetween.

3. A gravity traction apparatus as described in claim 2, in which the upper ends of the front legs are rigidly connected to said one tab of each bearing plate, and a tie-bar is connected to and extends transversely between the front legs adjacent the upper ends thereof.

* * * * *